US012590427B2

(12) United States Patent
Ustach et al.

(10) Patent No.: US 12,590,427 B2
(45) Date of Patent: Mar. 31, 2026

(54) GUARD RAIL SYSTEM

(71) Applicant: McCue Corporation, Danvers, MA (US)

(72) Inventors: Thomas Ustach, Boston, MA (US); David DiAntonio, Andover, MA (US); Amanda Gene Meltzer, Columbia Falls, MT (US)

(73) Assignee: McCue Corporation, Danvers, MA (US)

( * ) Notice: Subject to any disclaimer, the term of this patent is extended or adjusted under 35 U.S.C. 154(b) by 255 days.

(21) Appl. No.: 18/127,306

(22) Filed: Mar. 28, 2023

(65) Prior Publication Data

US 2023/0304238 A1 Sep. 28, 2023

Related U.S. Application Data

(60) Provisional application No. 63/324,286, filed on Mar. 28, 2022.

(51) Int. Cl.
*E01F 15/02* (2006.01)
*E01F 15/04* (2006.01)
*E01F 15/14* (2006.01)

(52) U.S. Cl.
CPC ..... *E01F 15/025* (2013.01); *E01F 15/0461* (2013.01); *E01F 15/0476* (2013.01); *E01F 15/0484* (2013.01); *E01F 15/146* (2013.01)

(58) Field of Classification Search
CPC ..... E01F 15/025; E01F 15/04; E01F 15/0407; E01F 15/0438; E01F 15/0453;
(Continued)

(56) References Cited

U.S. PATENT DOCUMENTS 4,269,534 A * 5/1981 Ryan ..... E01F 9/681 40/607.1
5,354,037 A * 10/1994 Venegas, Jr. ..... E01F 15/0453 256/65.02
(Continued)

FOREIGN PATENT DOCUMENTS

DE 202021100205 U1 * 4/2021
KR 100795417 B1 * 1/2008
(Continued)

*Primary Examiner* — Jonathan P Masinick
(74) *Attorney, Agent, or Firm* — Young Basile Hanlon & MacFarlane, P.C.

(57) ABSTRACT

A protective barrier includes a rigid upright member including a post, a fitting having a housing with a first outer surface and a first inner surface. The housing includes a first hole extending from the first outer surface to the first inner surface; a first end, a second end and an inner chamber defined by the inner surface of the housing and extending from the first end to the second end; the first end having a flange sized and shaped for attachment to an outer surface of the rigid upright; at least one support member disposed within the inner chamber and extending from the first end toward the second end of the housing, the support member including a second hole. The protective barrier also comprises a hollow rail including a third end sized and shaped for being received within the inner chamber, the hollow plastic rail including a third hole; and a fastener extending through the first hole, second hole and third hole such that the hollow plastic rail is secured to the fitting.

17 Claims, 11 Drawing Sheets

(58) Field of Classification Search
CPC ..... E01F 15/0461; E01F 15/0469; E01F 15/0476; E01F 15/0484; E01F 15/14; E01F 15/145; E01F 15/146; E01F 9/623; E01F 9/627; E01F 9/629; E04H 17/1447; E04H 17/1488; E04H 17/20; E04H 17/21; E04H 17/22
See application file for complete search history.

(56) References Cited

U.S. PATENT DOCUMENTS

| | | | | |
|---|---|---|---|---|
| 5,597,262 | A * | 1/1997 | Beavers | E01F 9/627 116/63 P |
| 7,125,002 | B2 * | 10/2006 | Platt | E04H 17/1488 256/65.02 |
| 10,060,154 | B2 * | 8/2018 | McCue | B65G 1/02 |
| 10,577,825 | B1 * | 3/2020 | Givens | E04H 17/1456 |
| 11,427,976 | B2 * | 8/2022 | Ustach | E01F 13/00 |
| 11,692,604 | B2 * | 7/2023 | Mesa | E01F 15/0469 404/7 |
| 12,180,662 | B2 * | 12/2024 | Ustach | E01F 9/629 |
| 12,227,959 | B1 * | 2/2025 | Nichols | E04H 17/1488 |
| 12,258,719 | B2 * | 3/2025 | Ustach | E01F 15/146 |
| 2004/0206028 | A1 * | 10/2004 | Terrels | E04H 17/1447 52/287.1 |
| 2006/0081829 | A1 | 4/2006 | Platt | |
| 2006/0113515 | A1 | 6/2006 | Venegas | |
| 2009/0200532 | A1 * | 8/2009 | Platt | E04F 11/1834 256/67 |
| 2018/0283040 | A1 * | 10/2018 | McCue | E04H 17/1465 |
| 2020/0191222 | A1 * | 6/2020 | Mesa | F16F 7/00 |
| 2021/0102351 | A1 * | 4/2021 | Mesa | E01F 15/143 |
| 2023/0183930 | A1 * | 6/2023 | Ustach | E01F 15/14 404/10 |
| 2023/0304238 | A1 * | 9/2023 | Ustach | E01F 15/025 |
| 2024/0060254 | A1 * | 2/2024 | Ustach | E01F 15/14 |
| 2024/0317165 | A1 * | 9/2024 | Meltzer | B60R 19/023 |

FOREIGN PATENT DOCUMENTS

| | | | |
|---|---|---|---|
| KR | 20090030410 | A | 3/2009 |
| KR | 101206946 | B1 * | 11/2012 |
| KR | 20130092227 | A | 8/2013 |
| KR | 101745628 | B1 | 6/2017 |
| KR | 101935522 | B1 | 1/2019 |
| KR | 200491930 | Y1 | 7/2020 |

* cited by examiner

GUARD RAIL SYSTEM

CROSS-REFERENCES TO RELATED APPLICATIONS

This application claims the benefit of U.S. Provisional Application No. 63/324,286 filed Mar. 28, 2022, the entire contents of which are incorporated herein by reference.

BACKGROUND OF THE INVENTION

This invention relates to a modular guard rail system for, for example, an industrial or retail facility.

Warehouses, distributions centers, factories, and similar facilities often have large stock-handling equipment such as fork trucks. This equipment is often used to move stock into, out of, and around the facility. In some examples, the stock is stored on shelving (e.g., pallet racks), in which case the stock-handling equipment must navigate through the shelving to move stock to and from the shelving. Some facilities include (e.g., support columns or walls) that the stock handling equipment must avoid bumping into as it travels through the facility.

As an operator navigates stock-handling equipment through a facility, it is possible for the operator to inadvertently cause the stock handling equipment to collide with obstacles such as shelving, support columns, or walls. Such collisions are especially common as the stock handling equipment is navigated around corners (e.g., a corner of a pallet rack).

When stock-handling equipment collides with an obstacle, both the obstacle and the stock handling equipment can become damaged. In the case of shelving, a strong enough collision can cause the shelving to collapse.

SUMMARY OF THE INVENTION

In a general aspect of the invention, a protective barrier comprises a rigid upright member including a post, a fitting having a housing with a first outer surface and a first inner surface. The housing includes a first hole extending from the first outer surface to the first inner surface; a first end, a second end and an inner chamber defined by the inner surface of the housing and extending from the first end to the second end; the first end having a flange sized and shaped for attachment to an outer surface of the rigid upright; at least one support member disposed within the inner chamber and extending from the first end toward the second end of the housing, the support member including a second hole. The protective barrier also comprises a hollow rail including a third end sized and shaped for being received within the inner chamber, the hollow plastic rail including a third hole; and a fastener extending through the first hole, second hole and third hole such that the hollow plastic rail is secured to the fitting.

Embodiments of this aspect of the invention may include one or more of the following features.

At least one support member of the at least one support members comprises a wall defining a second inner surface and a second outer surface, wherein the second hole extends from the second outer surface to the first inner surface.

At least one of the first hole and the second hole can be threaded. Furthermore, the fastener (e.g., a screw) can be threaded. In some embodiments, the first hole and the second hole are aligned.

The housing can further include a fourth hole extending from the first outer surface to the first inner surface. The at least one support member can also include a fifth hole. The fourth hole and the fifth hole can be aligned. The housing can also include two support members, wherein the hole of each support member is aligned with one of the first hole and the fourth hole.

The hollow rail can comprise plastic and be hollow throughout its length. The post can comprise metal.

In another general aspect of the invention, a protective barrier comprises a rigid upright member including a metal post; a hollow plastic rail; and an impact absorbing connection interposed between the post and hollow rail, wherein the impact absorbing connection is configured to provide increased mechanical support between the post and the hollow rail by being fastened to the hollow rail by a fastener which passes through a housing of the impact absorbing connection, the hollow rail, and at least one support of the impact absorbing connection, wherein an end of the hollow rail is interposed between the housing and the support.

Embodiments of this aspect of the invention may include one or more of the following features.

The fastener can extend through a first hole in the housing, a second hole in the hollow plastic rail, and a third hole in the support.

The impact absorbing connection can include two supports, and the fastener can extend through a first hole in the housing, a second hole in the hollow plastic rail, and a third hole in the first support, and a second fastener extends through a fourth hole in the housing, a fifth hole in the hollow plastic rail, and a sixth hole in the second support.

The protective barrier can further comprise a second fastener which passes through the housing of the impact absorbing connection, the hollow plastic rail, and the support of the impact absorbing connection.

The fastener is a screw, and the hollow plastic rail can be hollow throughout a length of the hollow plastic rail.

Aspects described herein relate to a modular guard rail system and associated guard rail couplings which may be installed in a warehouse to protect warehouse workers, machinery, and goods.

In a guard rail system, the coupling between a rail and a post of the guard rail system may be a failure point of the system when put under stress. As guard rails are installed in a warehouse, it would thereby be advantageous for a rail system to have modular rails and associated rail couplings, to allow for adaptive guard rail systems which can be tailored to the context in which the system will be placed. Further, a guard rail system having a coupling which can withstand significant stress would be advantageous, by creating a guard rail system with a potentially higher flexibility and/or stress tolerance.

Other features and advantages of the invention are apparent from the following description, and from the claims.

DETAILED DESCRIPTION

Figure 1:
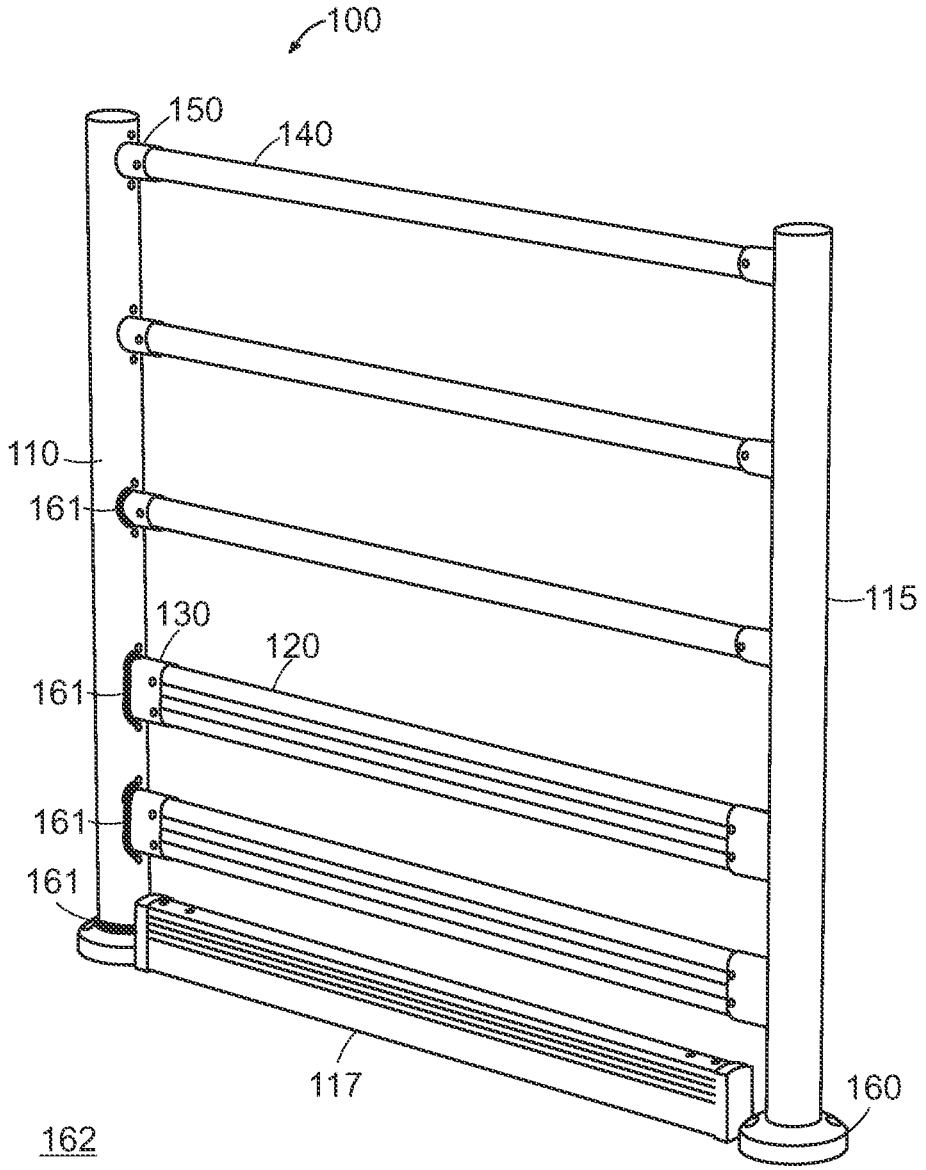
FIG. 1 is a perspective view of a portion of a modular barricade.

Referring to FIG. 1, a modular barricade 100 (sometimes referred to as an apparatus comprising a modular barricade) includes couplings 130, 150 that couple posts 110, 115 to guard rails 120, 140 (hereafter "rails"). Anchors 160 secure the posts 110, 115 to a surface, such as the ground 162. In the illustrated embodiment, the posts 110, 115 and the rails 120, 140 are horizontal and the posts 110, 115 are vertical.

In some embodiments, it is important to prevent contaminants from entering or being entrapped by the barricade's various components. For example, in a food processing environment, entry or entrapment of food may result in unsanitary conditions that arise upon decomposition of the food. To suppress the likelihood of such entry, it is useful to provide gaskets 161 to seal the various joints shown in FIG. 1.

The modular barricade 100 is, as its name implies, modular. As a result, it is possible to install various specialized rails 120, 140 between the posts 110 and to do so in any order. This allows the modular barricade 100 to be customized to its environment and to the nature and dimensions of that which the modular barricade 100 has been installed to protect. As a result of this modular construction, it is possible to choose the height, width, and number of rails 120, 140 and to assemble them at selected locations along the posts 110, 115. As a result, the modular barricade 100 offers the significant advantage of allowing the use of different kinds of posts 110, 115 and rails 120, 140 in different placements so as to construct a barricade 100 that is specifically adapted to its environment.

The illustrated modular barricade 100 features rails 120, 140 of different types (e.g., different rails having different sizes or different geometries). In particular, the illustrated modular barricade 100 includes two broad rails 120 and three narrow rails 140. In addition, the modular barricade 100 includes a low-level floor barrier 117 positioned (or disposed) on the ground 162 and between the anchors 160.

Rails 120, 140 of different sizes offer different advantages and disadvantages. This makes different rails 120, 140 suited to different applications. A broad rail 120 is often considered useful as a barrier for heavy machinery. However, it is also heavier and more costly. In contrast, a narrow rail 140 serves quite well as a barrier for workers and offers a lighter alternative when no heavy machinery is expected.

The coupling 130 that secures a rail 120, 140 to a post 110, 115 depends on the type of rail 120, 140 that it has been called upon to couple. In particular, the coupling's form depends on the rail's size or shape. Thus, a broad rail 120 requires a broad coupling 130 to fix the broad rail 120 to the post 110. The narrow rail 140 instead requires a narrow coupling 150 to fix the narrow rail 140 to the post 110.

Rails 120, 140 are also made in different lengths and cross sections. In addition, there exist rails 120, 140 made of different materials having particularly useful properties for certain applications. For instance, in the interest of electromagnetic compatibility, it may be desirable to avoid metal rails. It may also be desirable for rails to have specific surface characteristics, such as hydrophobicity, or roughness. In other cases, it is desirable for rails to have built-in sensors that act as proximity alarms to trigger warnings, such as lamps or sirens that are coupled to the barricade 100 to warn of an impending collision.

Additionally, it is possible to select rails 120, 140 of different colors. In some cases, the color is one that calls attention to the barricade's presence. In other applications, the rails 120, 140 are of a more muted color to aesthetically blend with the environment. In some embodiments, the rails 120, 140 include ornamental features, images, or text. Such images and text are useful in retail applications for advertising and promotion as well as for issuing warnings in connection with safety hazards. To enable delineation of an irregularly shaped region, there also exist rails 120, 140 with various radii of curvature and different lengths.

It is apparent therefore that the barricade's modular construction enables it to define an area having a perimeter of essentially arbitrary shape.

However, this is only the beginning. The modular barricade 100 is also able to assign different properties to different segments of the perimeter. For example, in some cases, one portion of a perimeter traverses a first space that abounds with forklifts and other heavy moving machinery, another portion traverses a second space in which only pedestrians are present, and yet another portion traverses a third space in which it is exposed to sun and rain. The modular barricade 100 effortlessly accommodates these different hazards by having broad rails 120 in the first space, narrow rails 140 in the second space, and weather-resistant rails in the third space.

Moreover, when considered at a broader level, the modular barricade 100 defines vertically stacked layers, each of which is protected in a different way. For example, the modular barricade 100 shown in FIG. 1 defines a lower layer that is guarded by broad rails 120 and an upper layer that is guarded by narrow rails 140. These two stacked layers differ in an important property: the manner in which they absorb kinetic energy applied on impact. In particular, the upper layer would be expected to fail (or break) when the kinetic energy of a collision exceeds a first value, and the second layer would be expected to fail when the kinetic energy of a collision exceeds a second value that exceeds the first value (and remain unbroken otherwise due to the second layer being stronger than the first).

Figure 2:
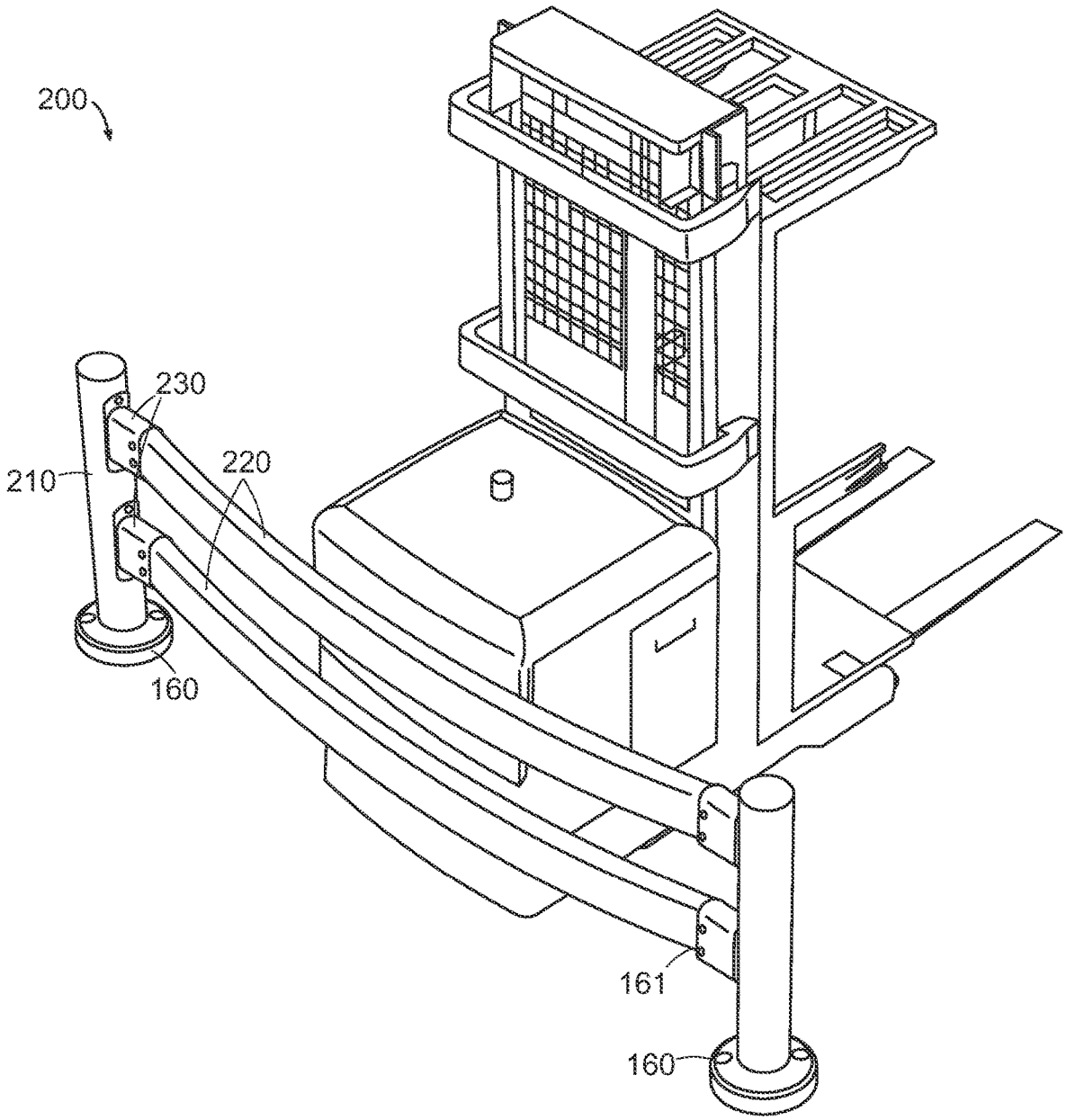
FIG. 2 is an overhead view of a modular barricade in the midst of sustaining a collision.

The ability to absorb kinetic energy on impact is a particularly important function of the modular barricade 100. Given its function, it is inevitable that a modular barricade 100, 200 will occasionally sustain impact, as shown in FIG. 2. In order to halt the impacting object, the modular barricade 100 must absorb its kinetic energy, preferably maintaining its integrity in the process.

FIG. 2 shows a forklift that has backed into rails 220 that are coupled to posts 210 by couplings 230. The posts 210 are anchored to the ground by anchors 160. the rails 220 absorb the forklift's kinetic energy by flexing. This energy transmitted to the post 210 via the couplings 230 and ultimately to the floor via the anchors 160. For this scheme to work, the posts 210 should be more rigid than the rails 220.

In order to remain stationary upon impact, each coupling 130, 230 sustains a torque transmitted by the guard rails 220 and an equal and opposite torque transmitted by the post 210 to which it connects. These two opposing torques result in considerable internal stress in the coupling 130, 230.

It is preferable that the coupling 130, 230 repeatedly withstand this stress without failing (e.g., by detaching from either of the coupling's associated posts 110 or rails 120 or by simply breaking). The remaining figures illustrate structural features of the coupling 130, 230 that promote its ability to repeatedly sustain these high internal stresses.

Figure 3A:
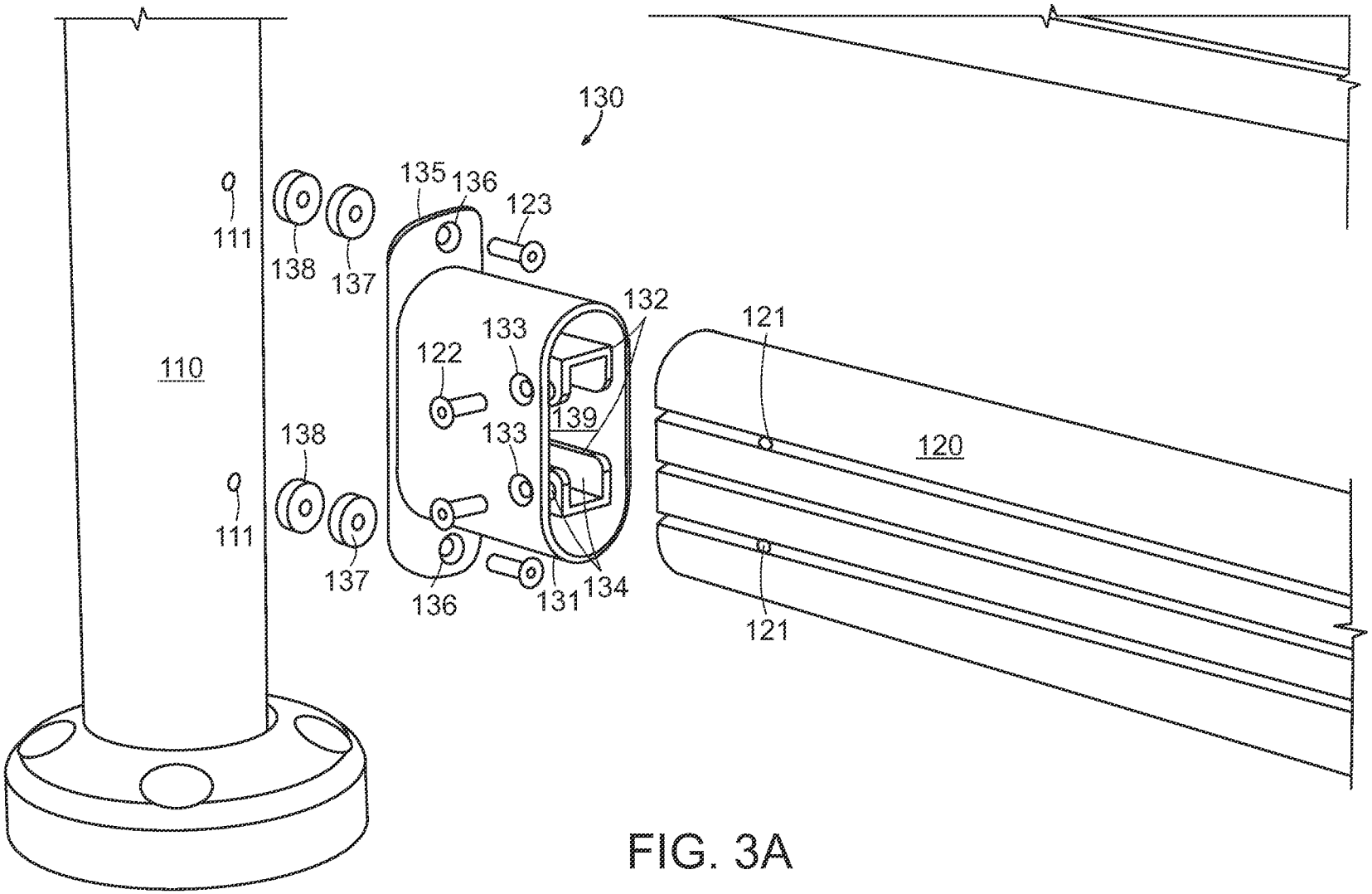
FIG. 3A shows a fastener implemented as a cam for either the post fastener or the rail fastener shown in FIG. 3A.

Referring to FIG. 3A, the coupling 130 features a housing 131 having a base from which a wall projects distally along a horizontal axis. The distally projecting wall defines a chamber 139 that is sized and shaped to receive the rail 120 through an open end of the housing. Vertically aligned upper and lower housing holes 133 extend through each of the housing's lateral surfaces.

An internal support 132 projects distally from the housing's base and through this chamber 139. In the embodiments of FIG. 3A, the internal support 132 comprises two prongs. However, other embodiments feature an internal support 132 having different numbers of prongs.

The internal support 132 has lateral surfaces that face corresponding lateral surfaces of the housing 131. Internal-support holes 134 through these lateral surfaces of the internal support 132 align with corresponding ones of the housing holes 133.

The coupling 130 is a unitary structure with a complex shape. A useful way to manufacture such a coupling 130 relies on injection molding. Another suitable method relies on additive manufacturing.

The rail 120 has its own internal cavity. As a result, when correctly installed, the rail 120 extends all the way through the chamber 139 with the internal support 132 of the coupling 130 being disposed entirely within the rail's cavity. In this position, rail holes 121 on either side of the rail 120 align with both the housing holes 133 and the internal-support holes 134.

With the internal-support holes 134, the rail holes 121, and the housing holes 133 all correctly aligned, it is possible to insert a rail fastener 122 through all three holes. An example of a suitable rail fastener 122 is a screw. In the embodiment of FIG. 3A, there are two such rail fasteners 122 on each of the two lateral walls of the housing 131, for a total of four rail fasteners 122 to connect the rail 120 to the coupling 130. In general, at least two rails fasteners connect the rail to the coupling 130.

The foregoing configuration results in the rail 120 being tightly sandwiched between the housing 131 and the internal support 132. This has the unanticipated effect of, for a given input of kinetic energy, increasing the stress field at certain spatial locations within the coupling 130. Since the kinetic energy input is fixed, conservation of energy results in lowering the stress field at other spatial locations within the coupling 130. As a result, the rate of change of stress as a function of location in the coupling 130 tends to decrease. This increases the likelihood that the coupling 130 will retain its integrity in response to a given kinetic energy input from a collision.

Each internal support 132 is further configured to increase surface area of contact with the rail 120. This also promotes a lower spatial rate of change of stress dispersion within the coupling 130 and also promotes flexibility. In some examples, the internal support 132 is hollow. In others it is solid. In addition, the cross section of an internal support 132 varies among different embodiments. Because the internal support 132 and the rail 120 cooperate, the shape of the support's shape depends on that of the rail 120.

The existence of a deep chamber 139 permits the rail holes 121 to be located at a significant distance from an end of the rail 120. This turns out to be advantageous. The walls defining the rail hole 121 sustain considerable force during a collision. As a result, splintering and breakage are more likely at the rail holes 121 than at other positions on the rail 120.

As is apparent from FIG. 3A, by having the rail 121 penetrate deeply into the chamber 139, it is possible to set the rail holes 121 back from the rail's end by a distance that is close to the depth of the chamber 139. This reduces the likelihood of breakage at or near the rail holes 121 during a collision. That is, a plane perpendicular to the internal support bisects said housing. The housing has an open end that receives the rail and a distal portion. A portion of the housing in the distal portion of the housing is closer to the open end than it is to the plane. The rail fasteners pass through the distal portion.

In addition to being attached to the rail 120, the coupling 130 also has to be attached to the post 110. For this purpose, the coupling's base extends laterally outward to form a coupling flange 135 having upper and lower flange holes 136 extending therethrough. The flange holes 136 are vertically offset so as to match a vertical offset in corresponding post holes 111 in the post 110. As a result, a correctly aligned coupling 130 permits fasteners to pass through the flange holes 136 and into corresponding post holes 111 so as to fix the coupling 130 to the post 110.

FIG. 3A further shows post fasteners 123, resilient washers 137 and nuts 138 that are used for connecting the coupling flange 135 to the post 110. During a collision, the washers 137 deform. This is useful for absorbing some of the kinetic energy from the collision, thereby further reducing the stress field within the coupling 130.

A variety of placements are possible for the washers 137 and the nuts 138.

Figure 3B:
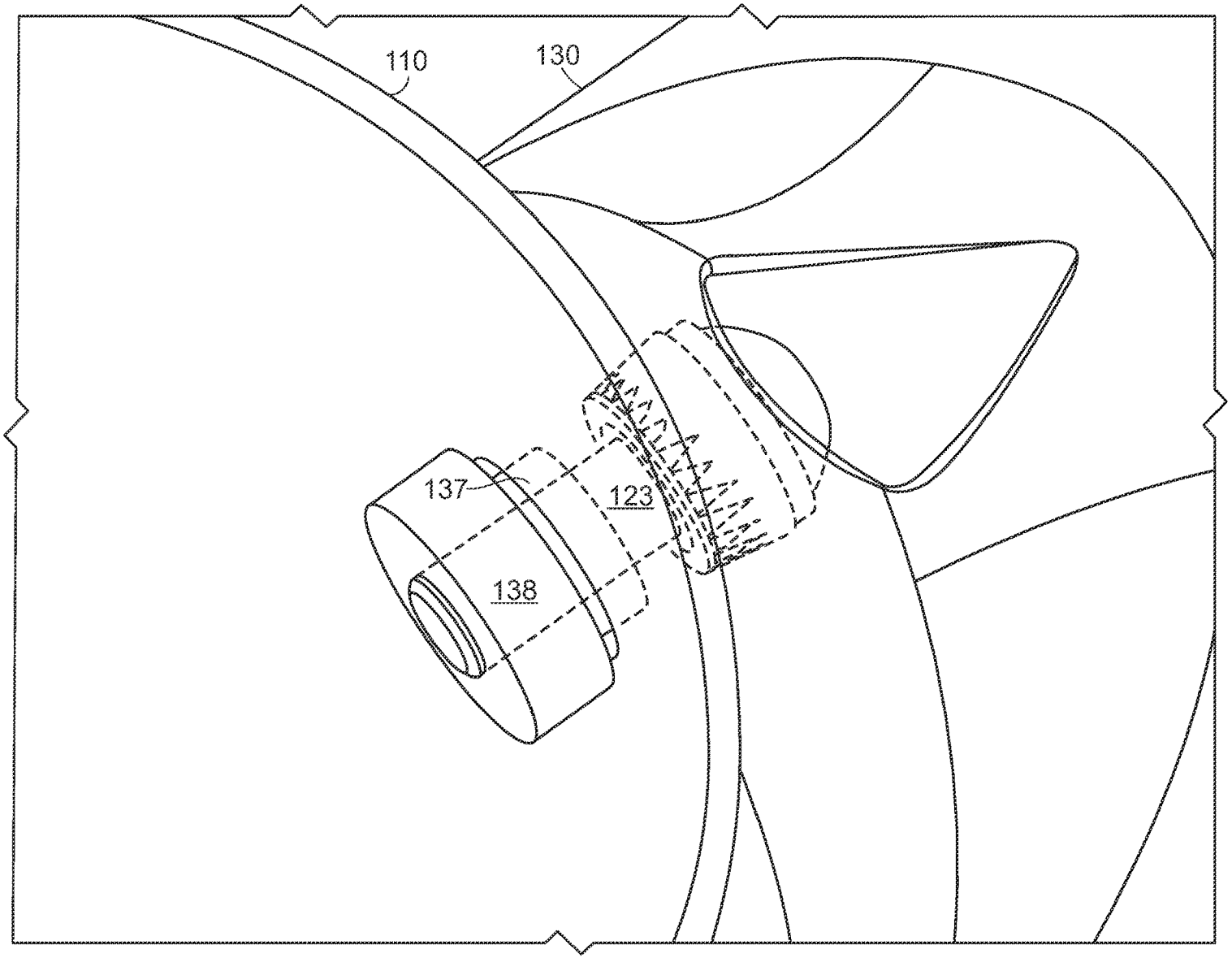
FIG. 3B shows a post fastener of the type shown in FIG. 3A in which the nut and washer are inside the post.

In some embodiments, the post 110 is a hollow post and the flexible washers 137 and the nuts 138 are located within the post's hollow, as shown in FIG. 3B. In such embodiments, the nut 138 is a threaded nut that receives a post fastener 123 that takes the form of threaded screw that passes through the coupling flange 135 to connect the coupling 130 to the post 110. To carry out this attachment process, one would extend one's hand into the post 110 to hold the washers 137 and nuts 138 while the post fastener 123 is passed though the holes of the respective holes in the coupling flange 135. In cases in which the space available is insufficient to insert one's hand, a suitable tool is used.

Figure 3C:
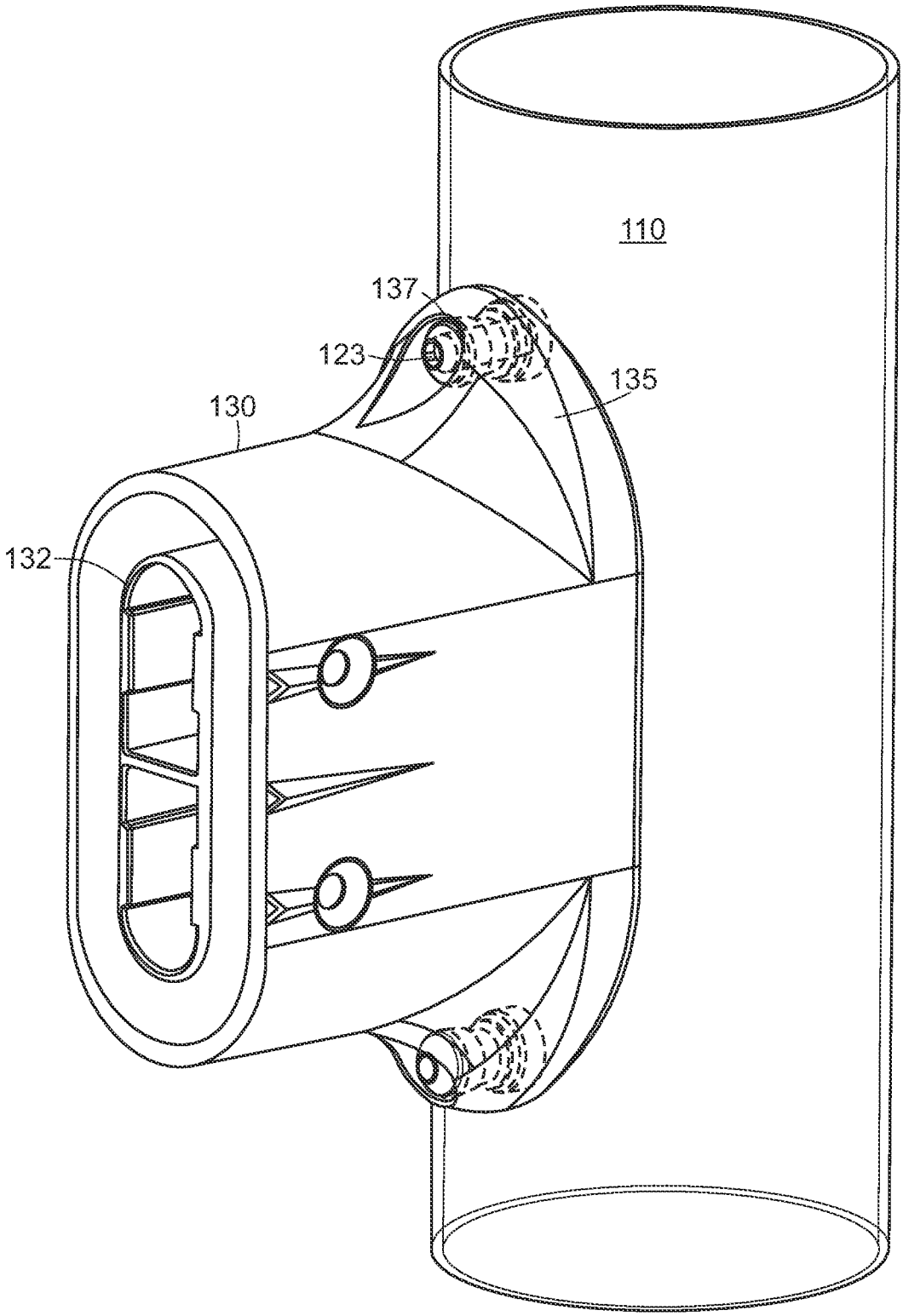
FIG. 3C shows a post fastener of the type shown in FIG. 3A in which the washer is outside the post.

In other embodiments, an example of which is shown in FIG. 3C, the nut 138 is welded to an interior wall of the post 110 so as to surround the flange hole 136, thereby simplifying the task of connecting the coupling 130 to the post 110. In such embodiments, the washer 137 lies outside the post 110 between the post's outer wall and the coupling flange 135, preferably embedded (or disposed) in a conforming recess.

Figure 3D:
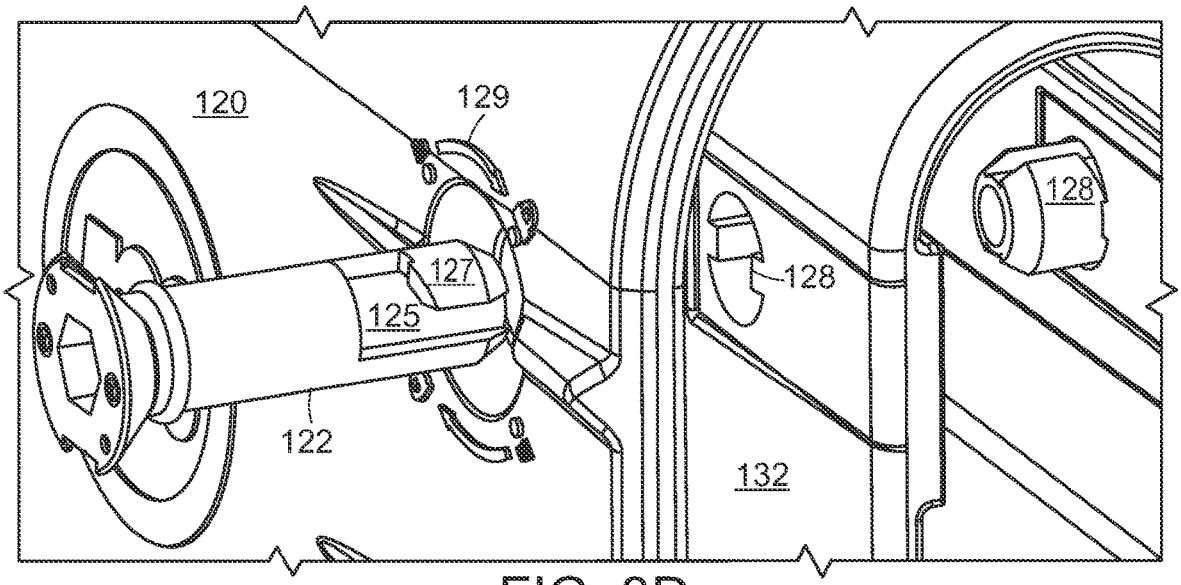
FIG. 3D is an exploded close-up perspective view of a first embodiment of a coupling that couples a guard rail to a post.

Referring now to FIG. 3D, another embodiment of a post fastener 123 or a rail fastener 122 takes the form of a shaft 125 having a radially projecting cam 127 at an end thereof. In such embodiments, a receiving aperture 128 within the post 110 (in the case of the post fastener 123) or within the internal support 132 (in the case of the rail fastener 122) engages the cam 127 once the shaft 125 has been rotated to the correct angle. To ease installation, a guide 129 indicates the correct direction for rotating the shaft 125.

Figure 3E:
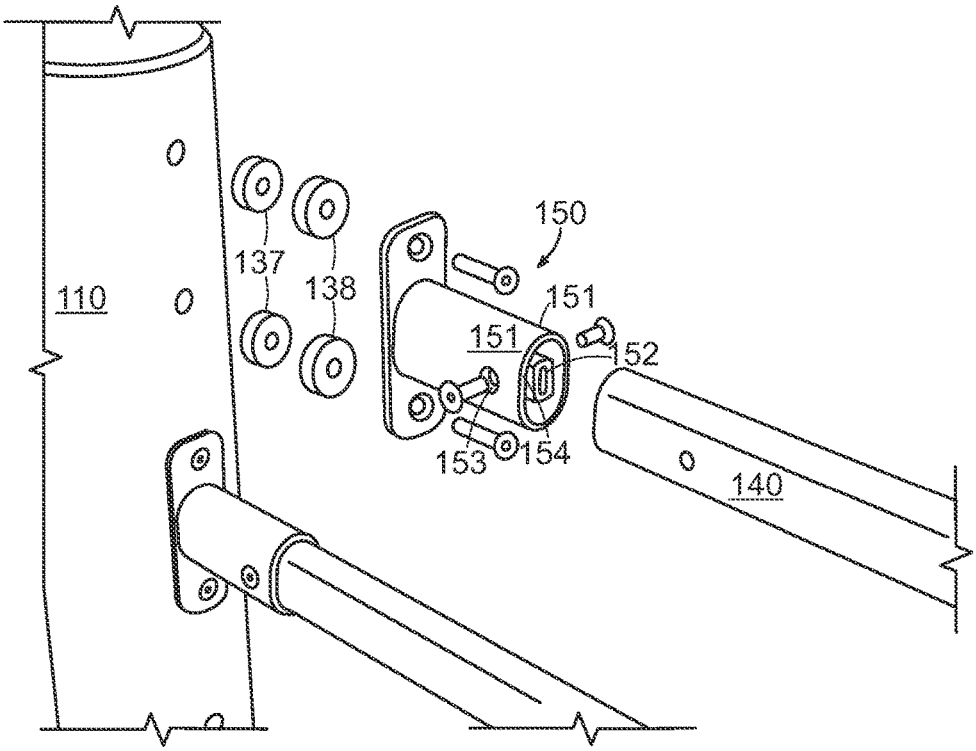
FIG. 3E is an exploded close-up perspective view of a second embodiment of a coupling that couples a guard rail to a post.

FIG. 3E shows a narrow coupling 150 that is similar to the broad coupling 130 shown in FIG. 3A. This narrow coupling 150 is useful for receiving a narrow rail 140. However, the principle of its operation is identical to that of the coupling 130 shown in FIG. 3A.

As was the case with the broad coupling 130, the narrow coupling 150 includes a housing 151 having a base from which walls project distally to define a chamber 154 through which an internal support 152 extends. The chamber 154 receives the narrow rail 140. As it does so, a cavity within the narrow rail 140 receives the internal support 152.

The narrow coupling 150 includes opposed lateral walls, each of which has a housing hole 153. Unlike the broad coupling 130, the narrow coupling 150 only has one housing hole 153 per lateral wall thereof. As a result, two screws instead of four screws are sufficient to fix the narrow coupling 150 to the narrow rail 140.

While the sandwiching mechanism of the housing 151 and the internal support 152 function similarly to that of the broad coupling 130, the difference in size and shape of the narrow rail 140 result in differences in shape and size of the narrow coupling's housing 151 and its internal support 152. In particular, the narrow coupling's housing 151 is not as deep as that of the broad coupling 130 and the narrow coupling's internal support 152 consists of only a single prong instead of dual prongs as was the case for the broad coupling lesser length than the housing 131, and the internal support 151 is a singular prong, unlike the internal support 132 of the broad coupling 130.

In addition to the two types of guard rails and guard rail couplings described above, other rail and rail coupling arrangements with similar designs may be used.

Figure 4:
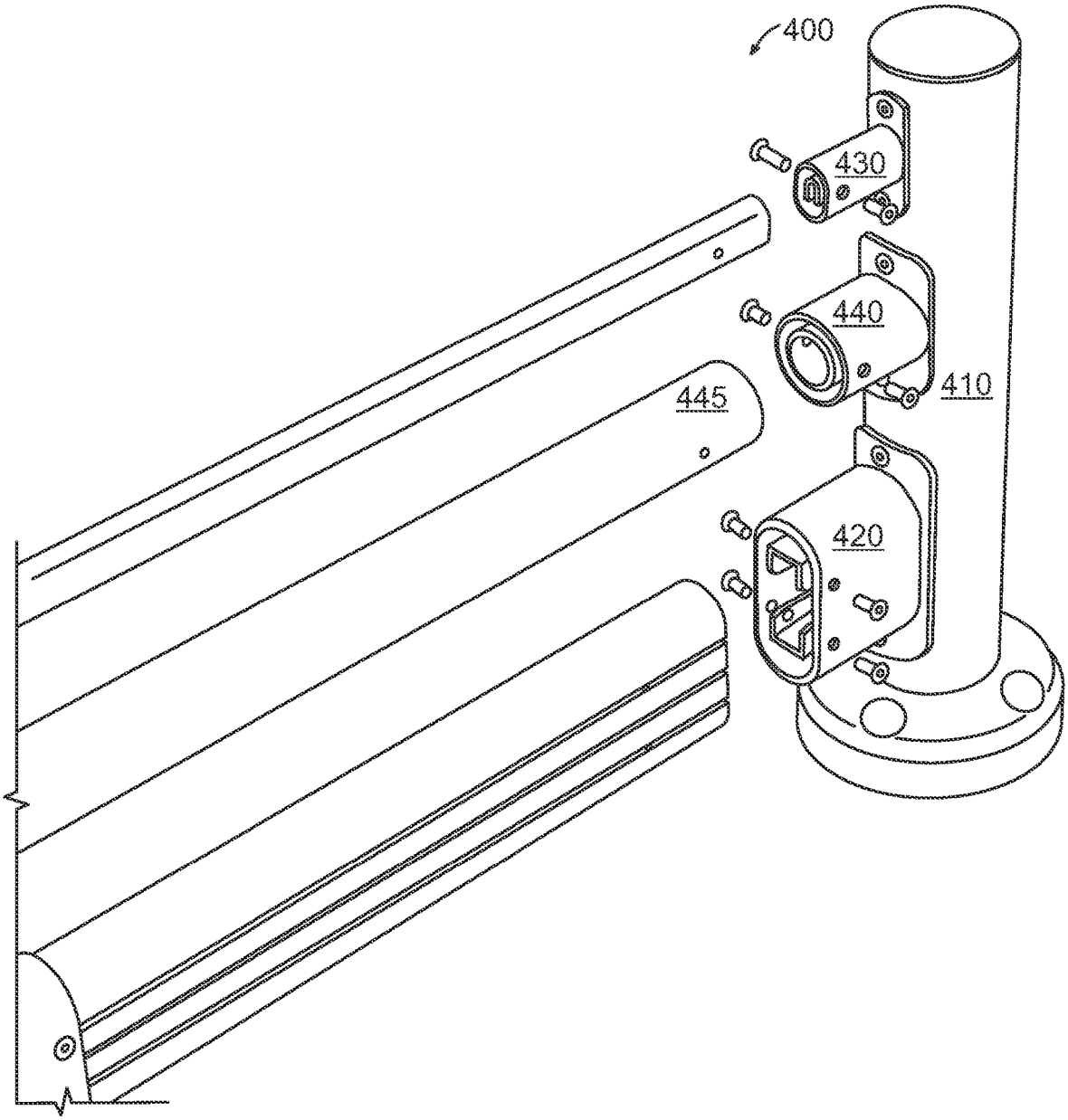
FIG. 4 is an exploded perspective view of a modular barricade with three different types of guard rails and associated guard rail couplings.

FIG. 4 shows a barricade 400 in which the post 410 supports three different types of rails: a broad rail, a narrow rail, and an intermediate rail 445. These are coupled to the post 410 by a broad coupling 420, a narrow coupling 430, and an intermediate coupling 440, respectively. The intermediate coupling 440 tolerates stress up to a threshold that is between the high threshold tolerated by the broad coupling 420 and the low threshold of the narrow coupling 430.

Modular barricades 400 use different types of couplings 420, 430, 440 to place different types of guard rails 120, 140, 220, 445 at different levels. In one example, a modular barricade 400 uses broad guard rails at lower sections of a post 410 to guard against cargo stacked by a forklift and narrow rails at higher sections of the post 410 where contact with a moving forklift is unlikely. In another example, a modular barricade 400 uses only one type of guard rail 120, 140, 220, 445.

As stated above, the modular barricade 100, 200, 400 is modular and therefore has interchangeable components. This allows customizability. For example, different kinds of coupling 130, 150, 230, 440 can be used on the same post 110, 115, 210, 410. In addition, different couplings 130, 150, 230, 440 are installable at substantially any height along the posts 110, 115, 210, 410.

In some embodiments, coupling flanges 135 are standardized to use a standard distance between post holes 111 to better improve modularity and interchangeability of rails 120, 140, 220, 445 and associated couplings 130, 150, 230, 440.

In other embodiments, coupling flanges 135 of different couplings 130, 150, 230, 440 use different distances between post holes 111 to increase stability or stress tolerance.

Still other embodiments feature couplings 130, 150, 230, 440 that use differing numbers or arrangements of fasteners and holes, internal supports, or nuts to adapt the coupling 130, 150, 230, 440 to sizing or stress tolerance needs of the coupling's associated guard rail 120, 140, 220, 445.

A variety of materials are usable for making posts 110, 115, 210, 410. Embodiments include those in which the posts 110, 115, 210, 410 comprise metal. Among these are embodiments that include an outer plastic coating or plastic sleeve.

The flexible washers 137 are typically made of rubber or of an elastomer. The nuts 138 typically comprise metal or some other rigid substance. The rails 120, 140, 220, 445 are typically plastic or some other similarly flexible substance. The screws may be replaced by other such fastening mechanisms. The anchor 160 is made of an elastomeric material, such as ethylene propylene diene monomer rubber.

Figure 5:
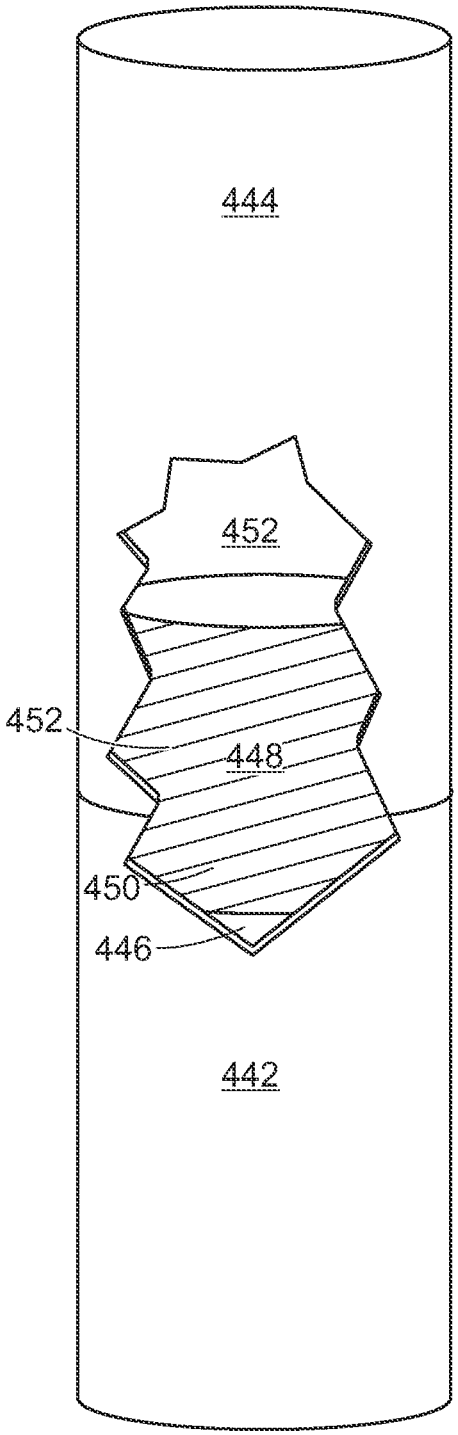
FIG. 5 shows a sleeve for stacking posts.

The height of the post 110 is arbitrary. However, as a result of practical constraints, it is difficult to ship or handle posts 110 of excessive height. However, to enable the construction of taller barricades 100 notwithstanding the foregoing difficulty, it is possible to join a lower post 442 to an upper post 444, as shown in FIG. 5. This is carried out by providing a recess 446 in a top end of the lower post 442. The recess 446 has an inner diameter that matches an outer diameter of a coupling sleeve 448.

The coupling sleeve 448 has a lower portion 450 and an upper portion 452. The lower portion 450 is inserted into the recess 446 and fastened thereto. The upper portion 450 protrudes upward out of the lower post 442 to engage a corresponding recess 452 at the bottom end of the upper post 444.

Figure 6:
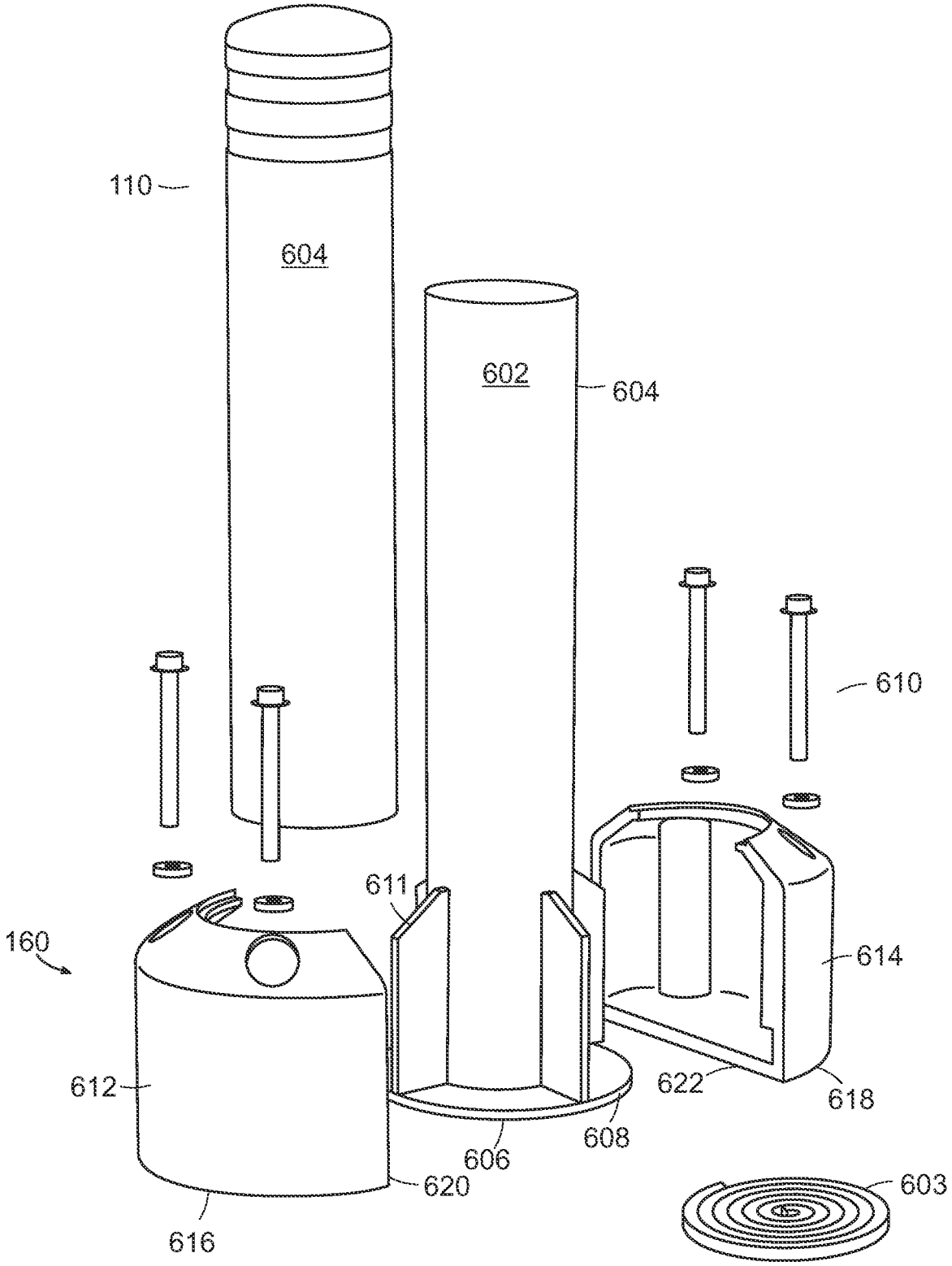
FIG. 6 shows a disassembled anchor that is used for anchoring the portion of the modular barricade in FIG. 1.
Figure 7:
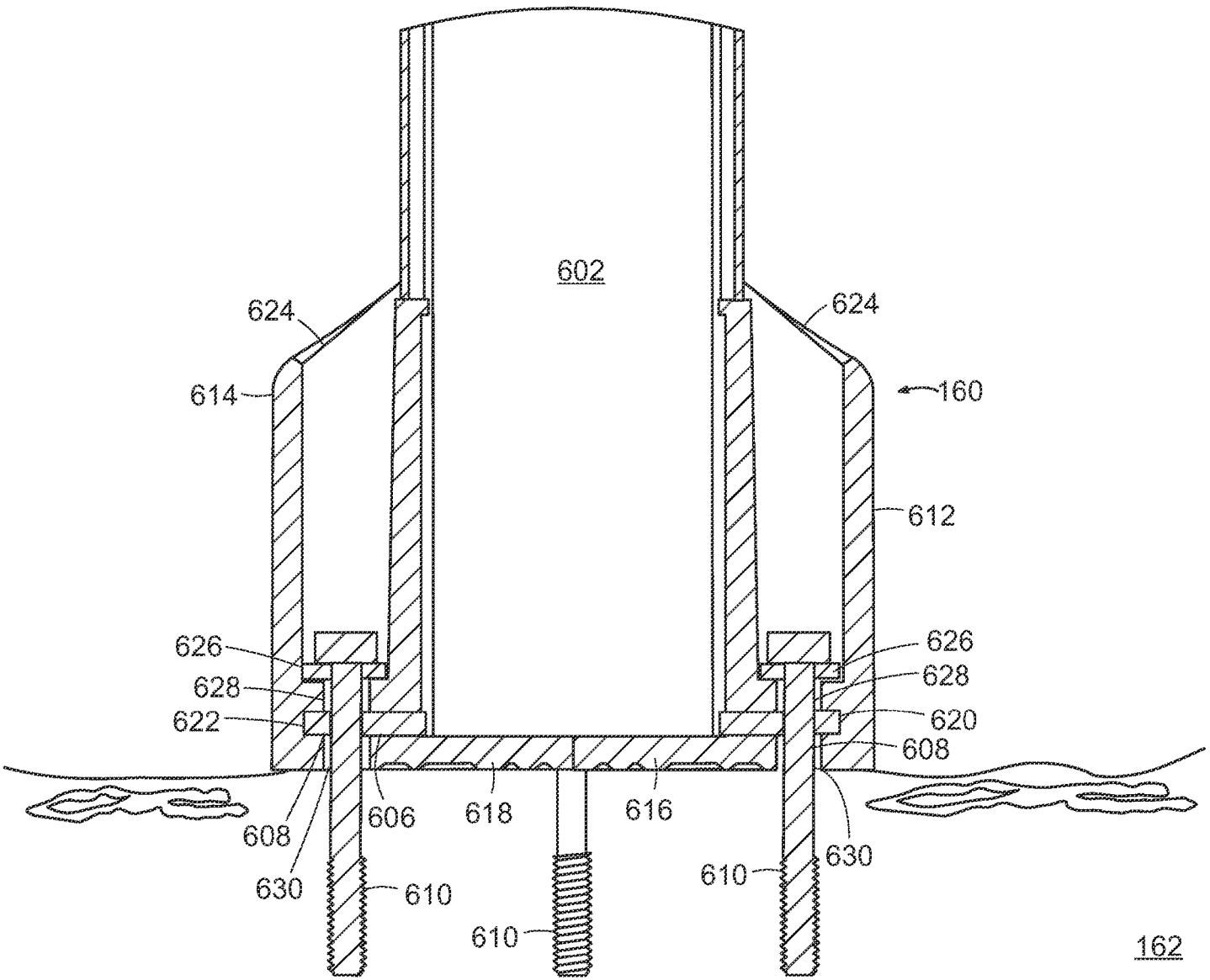
FIG. 7 shows the anchor shown in FIG. 6 after assembly thereof.
Figure 8:
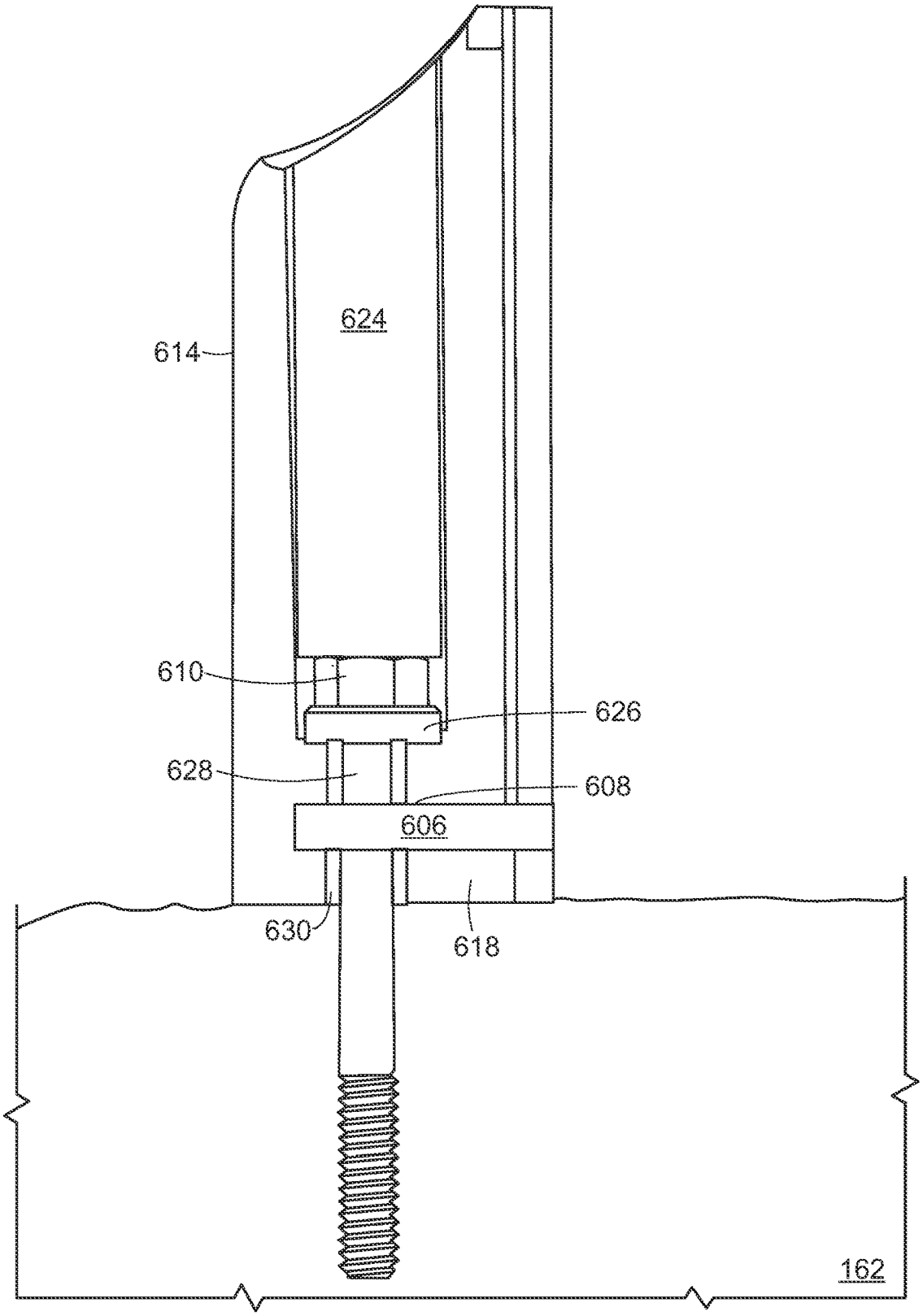
FIG. 8 shows a close-up of the recess that accommodates the anchoring screw in the anchor shown in FIG. 7.

To promote efficient dissipation of residual kinetic energy into the ground, the post 110 and the anchor 160 include certain features that are best seen in FIGS. 6-8.

The post 110 includes an inner core 602 and a plastic cover 604 that slides over the inner core 602. In some embodiments, the plastic cover 604 extends along a length of the inner core 602. In other examples, the plastic cover 604 rests (e.g., in a notch) on a top end of the anchor 160. In some examples, a distal end of the plastic cover 604 includes reflective rings to increase visibility. Optional foam tape 603 holds the plastic cover 604 and the inner core 602 apart to suppress rattle.

The inner core 602 comprises a hollow metal tube 604 having an anchoring flange 606 welded to its distal end. The anchoring flange 606 includes a number of through-holes 608 that accommodate anchoring screws 610 that connect the anchor 160 to the ground.

Reinforcing gussets 611 welded to the hollow metal tube 210 and the anchoring flange 606 promote the post's ability to resist deformation upon occurrence of a collision. In some examples, the gussets 611 extend axially and provide structural stability by strengthening the attachment of the anchoring flange 606 to the inner core 602 and reinforcing the distal end of the inner core 602 when the barricade 100 sustains an impact.

The anchor 160 is divided into first and second anchor halves 612, 614 that have been joined together. Each of the anchor halves 612, 614 has a semicircular footprint. When joined together, these semicircular footprints combined to form the anchor's circular footprint. In some embodiments, the walls of the anchor halves 612, 614 have a thickness of 0.75 inches.

Each of the anchor halves 612, 614 includes a corresponding floor 616, 618 and a corresponding semi-circular slot 620, 622 that is sized and shaped to conform to half of the anchoring flange 606. When the two anchor halves 612, 614 are assembled to form the anchor 160, the anchoring flange 606 of the inner core 602 rests on the floors 616, 618 of the two anchor halves 612, 614 and extends into the semi-circular slots 620, 622. The floors 616, 618 thus separate the anchoring flange 606 from the surface upon which the anchor 160 rests. As a result of its being nestled within the slots 620, 622, torque resulting from an impact with the post 110 is transferred to the ground as a result of the anchoring flange 606 hitting the top or bottom of the semi-circular slots 620, 622.

The first and second anchor halves 612, 614 each include recesses 624 that receive the anchoring screws 610. The process of attaching the anchor 160 to the ground 162 thus includes inserting the anchoring screws 610 into the recesses 624, passing them through washers 626. The washers 626 rest at the bottom of the anchor receptacles 334 and prevent the anchors 336 from passing entirely through the through-holes 340 at the bottom of the anchor receptacles 334. The anchoring screws 610 proceed through the through-holes 608 in the anchoring flange 606 and through-holes 630 in the floor 616, 618 before being driven into the ground 162.

In operation, an impact on the rail 120 exerts an impulse of torque on the inner core 602. This torque causes the anchoring flange 606 to tilt, which in turn compresses the washers 626. As a result, the washers 626 absorb a significant portion of the energy from the impact. As the impulse subsides, the washers 626 decompress and restore the anchoring flange 606 and hence the inner core 210 to its original vertical orientation.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. An apparatus comprising a modular barricade, said modular barricade comprising:

a rail, first and second posts, first and second couplings that receive corresponding first and second ends of said rail, rail fasteners that attach said ends of said rail to said first and second couplings, and post fasteners that attach said first coupling to said first post and said second coupling to said second post, wherein each of said first and second couplings comprises a housing that defines a chamber that receives said rail and an internal support that extends through said chamber and into said rail, wherein at least two of said rail fasteners pass through said housing, through said rail, and through said internal support, wherein said post comprises a recess on an outer surface thereof, and wherein said post fastener comprises a nut and a washer disposed in said recess.

2. The apparatus of claim 1, wherein said rail is a first rail and said barricade includes a second rail and third and fourth couplings, each of which receives an end of said second rail in a chamber formed by a housing thereof and each of which comprises an internal support that is disposed inside said second rail, wherein said third and fourth couplings couple said second rail to said first and second posts, and wherein said first and second rails have different geometries.

3. The apparatus of claim 1, wherein said rail is a first rail and said barricade further comprises a second rail and third and fourth couplings, each of which receives an end of said second rail in a chamber formed by a housing thereof and each of which comprises an internal support that is disposed inside said second rail, wherein said third and fourth couplings couple said second rail to said first and second posts, wherein, in response to an impulse of kinetic energy, said first rail breaks and said second rail remains unbroken.

4. The apparatus of claim 1, wherein said rail is a first rail and said barricade further comprises a second rail, said second rail being stronger than said first rail and being disposed below said first rail.

5. The apparatus of claim 1, wherein said internal support comprises first and second prongs that extend through said chamber.

6. The apparatus of claim 1, wherein each of said couplings comprise a flange that conforms to said post, wherein said post fasteners pass through said flange and into said post.

7. The apparatus of claim 1, wherein said post fastener comprises a nut that is welded inside said post and a threaded screw that engages said nut upon after having entered into said post from outside said post.

8. The apparatus of claim 1, further comprising a resilient material at a connection between said coupling and said post, wherein said resilient material deforms in response to an impulse of kinetic energy applied to said rail and exerts a restoring force on said coupling following said impulse.

9. The apparatus of claim 1, further comprising a gasket that seals a joint, wherein said joint is one of a joint between said first coupling and said rail, a joint between said first coupling and said post, and a joint between said post and an anchor that anchors said post to a surface.

10. The apparatus of claim 1, wherein said coupling comprises an injection molded plastic.

11. The apparatus of claim 1, wherein said post comprises an inner core and a plastic cover that covers said inner core, wherein said inner core comprises a hollow metal tube having an anchoring flange that protrudes radially from a distal end of said inner core and axially extending gussets that extend between said flange and said tube.

12. The apparatus of claim 1, further comprising an anchor that anchors said post to a surface, said anchor comprising a resilient material that exerts a restoring force in response to a torque applied to said post.

13. An apparatus comprising a modular barricade, said modular barricade comprising:

a rail, first and second posts, first and second couplings that receive corresponding first and second ends of said rail, rail fasteners that attach said ends of said rail to said first and second couplings, and post fasteners that attach said first coupling to said first post and said second coupling to said second post, wherein each of said first and second couplings comprises a housing that defines a chamber that receives said rail and an internal support that extends through said chamber and into said rail, wherein at least two of said rail fasteners pass through said housing, through said rail, and through said internal support, and wherein a plane perpendicular to said internal support bisects said housing, wherein said housing has an open end that receives said rail, wherein said housing comprises a distal portion, wherein a portion of said housing in said distal portion of said housing is closer to said open end than to said plane, and wherein said rail fasteners pass through said distal portion.

14. An apparatus comprising a modular barricade, said modular barricade comprising:

a rail, first and second posts, first and second couplings that receive corresponding first and second ends of said rail, rail fasteners that attach said ends of said rail to said first and second couplings, and post fasteners that attach said first coupling to said first post and said second coupling to said second post, wherein each of said first and second couplings comprises a housing that defines a chamber that receives said rail and an internal support that extends through said chamber and into said rail, wherein at least two of said rail fasteners pass through said housing, through said rail, and through said internal support, and wherein said post fastener comprises a nut, a resilient washer, and threaded screw that passes through said washer and engages said nut.

15. An apparatus comprising a modular barricade, said modular barricade comprising:

a rail, first and second posts, first and second couplings that receive corresponding first and second ends of said rail, rail fasteners that attach said ends of said rail to said first and second couplings, and post fasteners that attach said first coupling to said first post and said second coupling to said second post, wherein each of said first and second couplings comprises a housing that defines a chamber that receives said rail and an internal support that extends through said chamber and into said rail, wherein at least two of said rail fasteners pass through said housing, through said rail, and through said internal support, and wherein said post fastener comprises a shaft having a cam that protrudes from the shaft and a receiver that receives said cam to cause attachment between said coupling and said post.

16. An apparatus comprising a modular barricade, said modular barricade comprising:

a rail, first and second posts, first and second couplings that receive corresponding first and second ends of said rail, rail fasteners that attach said ends of said rail to said first and second couplings, and post fasteners that attach said first coupling to said first post and said second coupling to said second post, wherein each of said first and second couplings comprises a housing that defines a chamber that receives said rail and an internal support that extends through said chamber and into said rail, wherein at least two of said rail fasteners pass through said housing, through said rail, and through said internal support, and wherein said post comprises a lower section, an upper section, and a coupling sleeve having a bottom portion and a top portion, wherein said bottom portion is within a recess in a top end of said lower section, wherein said top portion is within a recess in a bottom end of said upper section, and wherein said sleeve is connected to said upper section and to said lower section.

17. An apparatus comprising a modular barricade, said modular barricade comprising:

a rail, first and second posts, first and second couplings that receive corresponding first and second ends of said rail, rail fasteners that attach said ends of said rail to said first and second couplings, and post fasteners that attach said first coupling to said first post and said second coupling to said second post, wherein each of said first and second couplings comprises a housing that defines a chamber that receives said rail and an internal support that extends through said chamber and into said rail, wherein at least two of said rail fasteners pass through said housing, through said rail, and through said internal support, and the modular barricade further comprising an anchor that comprises a resilient material and first and second anchor halves, each having a slot, wherein said slots, when said first and second halves have been joined, accommodate a flange that extends radially from a distal end of said post, wherein said resilient material is disposed such that, upon deformation thereof, said resilient material exerts a force that restores the post to its vertical orientation.

* * * * *